US008134819B2

(12) United States Patent
Di Maio et al.

(10) Patent No.: US 8,134,819 B2
(45) Date of Patent: Mar. 13, 2012

(54) SINGLE COIL ACTUATOR FOR LOW AND MEDIUM VOLTAGE APPLICATIONS

(75) Inventors: Luciano Di Maio, Milan (IT); Gabriele Valentino De Natale, Milan (IT)

(73) Assignee: ABB Technology AG, Zurich (CH)

( * ) Notice: Subject to any disclaimer, the term of this patent is extended or adjusted under 35 U.S.C. 154(b) by 163 days.

(21) Appl. No.: 12/511,687

(22) Filed: Jul. 29, 2009

(65) Prior Publication Data

US 2010/0027183 A1 Feb. 4, 2010

(30) Foreign Application Priority Data

Jul. 31, 2008 (EP) ..... 08161604

(51) Int. Cl.

| | |
|---|---|
| ***H01H 9/00*** | (2006.01) |
| ***H01H 47/00*** | (2006.01) |
| ***H01H 52/22*** | (2006.01) |
| ***H01H 51/30*** | (2006.01) |

(52) U.S. Cl. ..... 361/160

(58) Field of Classification Search ..... 361/160
See application file for complete search history.

(56) References Cited

U.S. PATENT DOCUMENTS

| | | | | |
|---|---|---|---|---|
| 3,735,215 A | | 5/1973 | Conrad | |
| 6,031,708 A | | 2/2000 | Guermeur | |
| 6,157,175 A | * | 12/2000 | Morinigo et al. | 322/28 |
| 6,504,698 B1 | * | 1/2003 | Durif et al. | 361/152 |
| 7,825,817 B2 | * | 11/2010 | Bray et al. | 340/632 |
| 2005/0128658 A1 | | 6/2005 | Frenz et al. | |
| 2007/0040608 A1 | | 2/2007 | Magrath et al. | |

FOREIGN PATENT DOCUMENTS

| | | |
|---|---|---|
| DE | 4205563 A1 | 8/1993 |
| DE | 10124109 A1 | 12/2002 |

OTHER PUBLICATIONS

Extended European Search Report issued in counterpart European Application No. 08161604.7.

* cited by examiner

*Primary Examiner* — Jared Fureman
*Assistant Examiner* — Lucy Thomas
(74) *Attorney, Agent, or Firm* — Connolly Bove Lodge & Hutz LLP

(57) ABSTRACT

A single coil actuator for low and medium voltage applications which comprises a single coil electromagnet and a power and control unit operatively connected to said single coil electromagnet. The power and control unit comprises:

a first control unit and a second control unit;

a power input operatively connected to an input filter and rectifier;

a power supply operatively connected to said input filter and rectifier and to said first and second control unit;

a power circuit operatively connected to said single coil electromagnet.

In the single coil actuator according to the invention, said first control unit is a microcontroller including analogue and digital inputs and outputs, and said second control unit is a PWM controller which controls the current flowing in the single coil electromagnet through said power circuit.

18 Claims, 3 Drawing Sheets

SINGLE COIL ACTUATOR FOR LOW AND MEDIUM VOLTAGE APPLICATIONS

CROSS REFERENCE TO RELATED APPLICATIONS

This application claims priority to EP 08 161.604.7 filed Jul. 1, 2008 the entire content is hereby incorporated by reference.

The present invention relates to a single coil actuator for low and medium voltage applications, in particular to a single coil actuator based on a single coil electromagnet having improved features in terms of performances and construction. The single coil actuator of the invention is conveniently used in low and medium voltage apparatuses. For the purposes of the present application the term medium voltage is referred to applications in the range of between 1 and 50 kV and low voltage is referred to applications in the range below 1 kV.

Coil-based actuators are frequently used in medium and low voltage apparatuses, for instance in low or medium voltage circuit breakers, disconnectors, contactors, for a wide variety of applications. A typical use of coil-based actuators is to release or lock mechanical parts of spring-actuated circuit breaker, following an opening or closing command. Other typical uses are, e.g., locking magnet for truck, command locking, and similar.

Conventional coil-based actuators normally comprise an electronics that drives two windings which are selectively energized for moving the anchor associated thereto ("launch" operation) and for maintaining it into position ("hold" operation). The two windings are powered directly from the supply rail and switched using two MOSFETs: the first coil is switched on to launch the electromagnet and the second coil allows to keep the electromagnet into position.

Even if conventional coil-based actuators are widely and satisfactorily used, they have however a number of disadvantages.

A first problem derives from the high number of variants which are needed to cover all operational ranges. As an example, up to 7 electromagnet variants are needed to support all voltage and current (AC and DC) operational ranges. In turn, each electromagnet variant needs its own driving electronics. Such a high number of variations has a negative impacts on manufacturing and handling costs.

A further disadvantage derives from the fact that conventional coil-based actuators normally do not foresee the possibility of checking the continuity and integrity of the coil and the driving electronics. In other words, it is normally not possible to detect a failure in the coil and check whether the driving circuit is properly working. This adversely affects the reliability of the medium voltage apparatus in which the coil-based actuators are installed and used.

Still another disadvantage derives from the fact that conventional coil-based actuators normally do not include protection against over-voltage, current and temperature. Thus in case of failure or misuse, the electronic circuit is subject to the risk of burning up.

Another disadvantage derives from the coil manufacturing; in particular the "hold" winding requires an high number of turns with very low wire sections. This makes the coil expensive.

Another disadvantage derives from the adaptability to operative requirements so as to allow operation of the coil within a wide range of temperature and input voltage. This implies that the windings have to be dimensioned to allow the sufficient currents to circulate at the lowest voltage and at the highest temperature. These currents correspond to the magnetomotive forces NI needed to "launch" and keep in "hold" the electromagnet. As result when the conventional coil-base actuator is supplied with the highest voltage and ambient temperature is the lowest, the currents "launch" and "hold" absorbed are much higher. For this reason power consumption and self heating of the conventional coil-based actuator are higher than required.

Furthermore the power MOSFETs and the windings wire sections need to be dimensioned for the highest current that may circulate in the coil when voltage is at maximum value and temperature is lowest. As a consequence the manufacturing costs are increased.

It is therefore an object of the present invention to provide a coil-based actuator for medium and low voltage applications that solves the above-mentioned problems.

More in particular, it is an object of the present invention to provide a coil-based actuator for medium and low voltage applications having a simplified design, maintaining at the same time the performances and the reliability needed for the intended applications.

As a further object, the present invention is aimed at providing a coil-based actuator for medium and low voltage applications that can be easily adapted to a wide number of intended applications.

Still another object of the present invention is to provide a coil-based actuator for medium and low voltage applications that can cover broad operational ranges, in terms of voltages and currents.

Another object of the present invention is to provide a coil-based actuator for medium and low voltage applications that is protected against over-voltages and over-currents.

A further object of the present invention is to provide a coil-based actuator for medium an low voltage applications in which the integrity and continuity of the coil and the associated driving electronics can be detected and checked.

Still another object of the present invention is to provide a coil-based actuator for medium and low voltage applications with reduced manufacturing and installation costs.

Thus, the present invention relates to a single coil actuator for low and medium voltage applications which comprises a single coil electromagnet and a power and control unit operatively connected to said single coil electromagnet. Said power and control unit comprises:

a first control unit and a second control unit;

a power input operatively connected to an input filter and rectifier;

a power supply operatively connected to said input filter and rectifier and to said first and second control unit;

a power circuit operatively connected to said single coil electromagnet.

In the single coil actuator according to the invention, said first control unit is a microcontroller including analogue and digital inputs and outputs, and said second control unit is a PWM controller which controls the current flowing in the single coil electromagnet through said power circuit.

In this way, it is possible to overcome some of the disadvantages and drawbacks of the actuators of the known art. In particular the mechanical complexity is reduced since only one coil is used. The electronic circuit drives said coil in a simple and effective manner: the first control unit (microcontroller) set the current that is allowed to circulate in the single-coil electromagnet while the second control unit (PWM controller) regulates the current circulating in the single-coil electromagnet. In this way it is possible to reduce the number of electromagnet variants, thereby significantly reducing the manufacturing and handling costs.

In addition, as better explained in the following description, the single coil actuator according to the invention includes diagnostic functions that allows checking the integrity and continuity of the coil and the associated electronic circuit.

Further characteristics and advantages of the invention will emerge from the description of preferred, but not exclusive, embodiments of the panel according to the invention, non-limiting examples of which are provided in the attached drawings, wherein:

BRIEF DESCRIPTION OF THE DRAWINGS

With reference to FIG. 1, a single coil actuator 1 according to the invention generally comprises a casing in which a single-coil electromagnet is housed. The casing has an opening that allows to interface the movable part of the electromagnet with a mechanism inside a medium voltage apparatus. As an example of mechanism, the primary command chain of a medium voltage circuit breaker can be mentioned. Inside the casing also a power and control unit 3 is properly positioned.

As shown in FIG. 1, one of the characteristics of the single coil actuator 1 according to the invention consists in that the power and control unit 3 is operatively connected to said single coil electromagnet 2 and comprises a first control unit 31 and a second control unit 32, whose functions will be described in details further on. The first control unit 31 is conveniently constituted by a microcontroller having a number of analogue and digital inputs and outputs 311, 312, 313, 314 and 315, while the second the second control unit 32 is a PWM controller which controls the current flowing in the single coil electromagnet 2.

Figure 1:
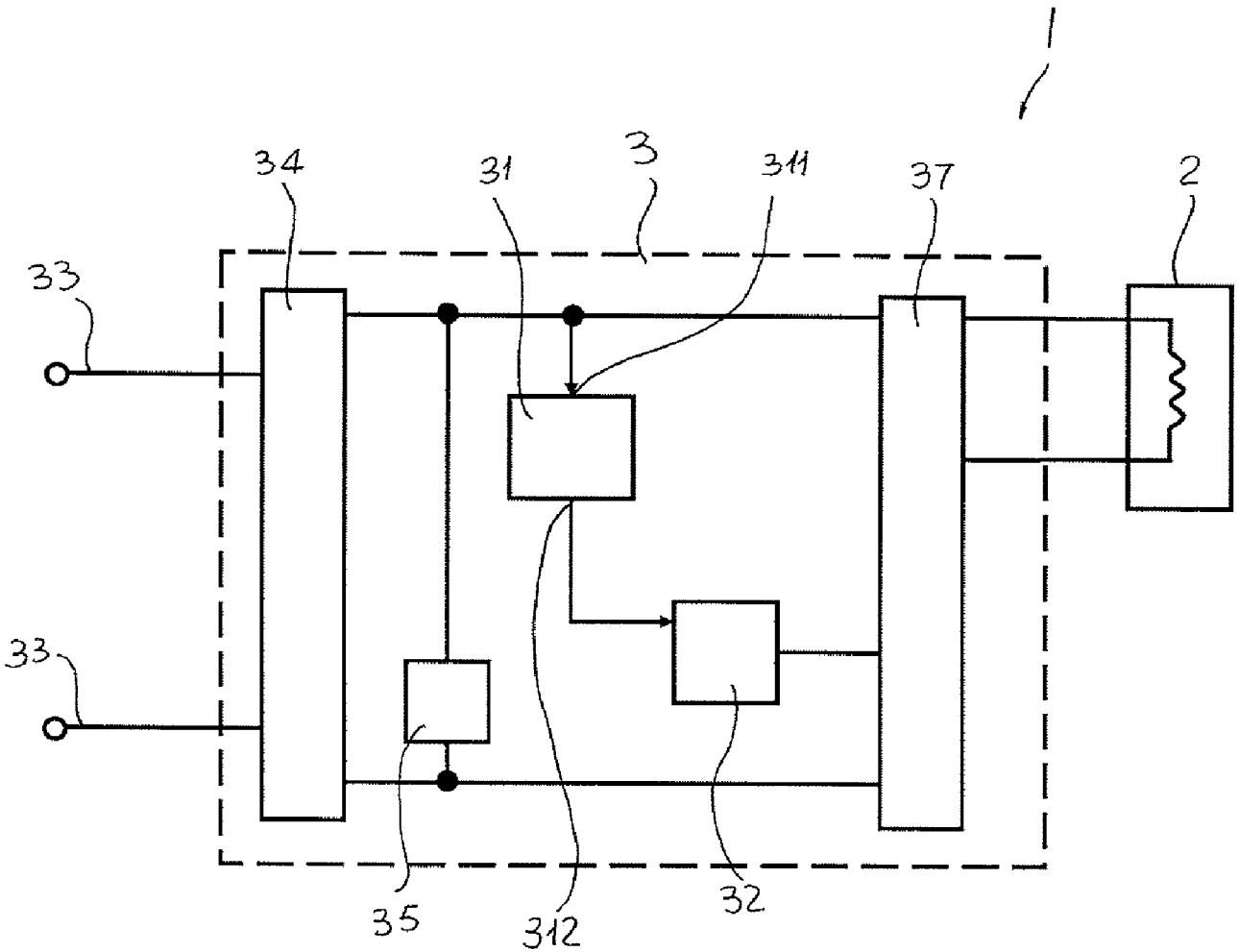
FIG. 1 is a schematic view of a first general embodiment of a single coil actuator according to the invention.

A further characteristics of the single coil actuator 1 according to the invention is that the power and control unit 3 also comprises a power input, schematically represented by the two cables 33, which is operatively connected to an input filter and rectifier 34. A power supply 35 is operatively connected to said input filter and rectifier 34 and to said first 31 and second 32 control unit. A power circuit 37 is operatively connected to said single coil electromagnet 2 and through said power circuit 37 the current flowing in the single coil electromagnet is controlled by said PWM controller 32.

From a functional standpoint the input filter and rectifiers 34 allows converting an AC power input to a DC, using for instance a bridge rectifier. Also, an input LC filter blocks high frequency currents generated by the PWM controller and avoids their entering into the power supply line. Other functions performed by the input filter and rectifiers 34 are the protection against over-voltage disturbance coming from the power line and the stopping of common mode high frequency currents.

The power supply block 35 converts the input voltage to the voltages needed by the microcontroller 31 and the PWM controller 32 and is normally a high voltage input linear regulator. The power supply signal output of 35 are not shown in FIGS. 2, 3 and 4.

Conveniently, the first control unit 31 is operatively connected to the input filter and rectifier 34 through a first input 311. The first input 311 is an analogue input for measuring the input voltage Vin and detect launch and release threshold values of said input voltage Vin. To this purpose the microcontroller conveniently includes a re-writable non-volatile area that can be used to store parameters and this area is used to store the switching threshold.

In order to reduce the number of electronic circuit variants, the software programmed in the microcontroller is conveniently capable of detecting the voltage applied at the first power up and configuring the thresholds accordingly. The set thresholds are then used from the second time the electronic circuit is powered. An alternative and preferred solution, is the one described in the co-filed and co-pending application having title "An Interface Module for Communication with an Electronic or an Electro-Mechanical Device of a Medium Voltage Interruption Unit", inventors Gabriele De Natale and Fabio Mannino, filed in the name of the same applicant.

The software can be installed through a software download and debug port (not shown).

Figure 2:
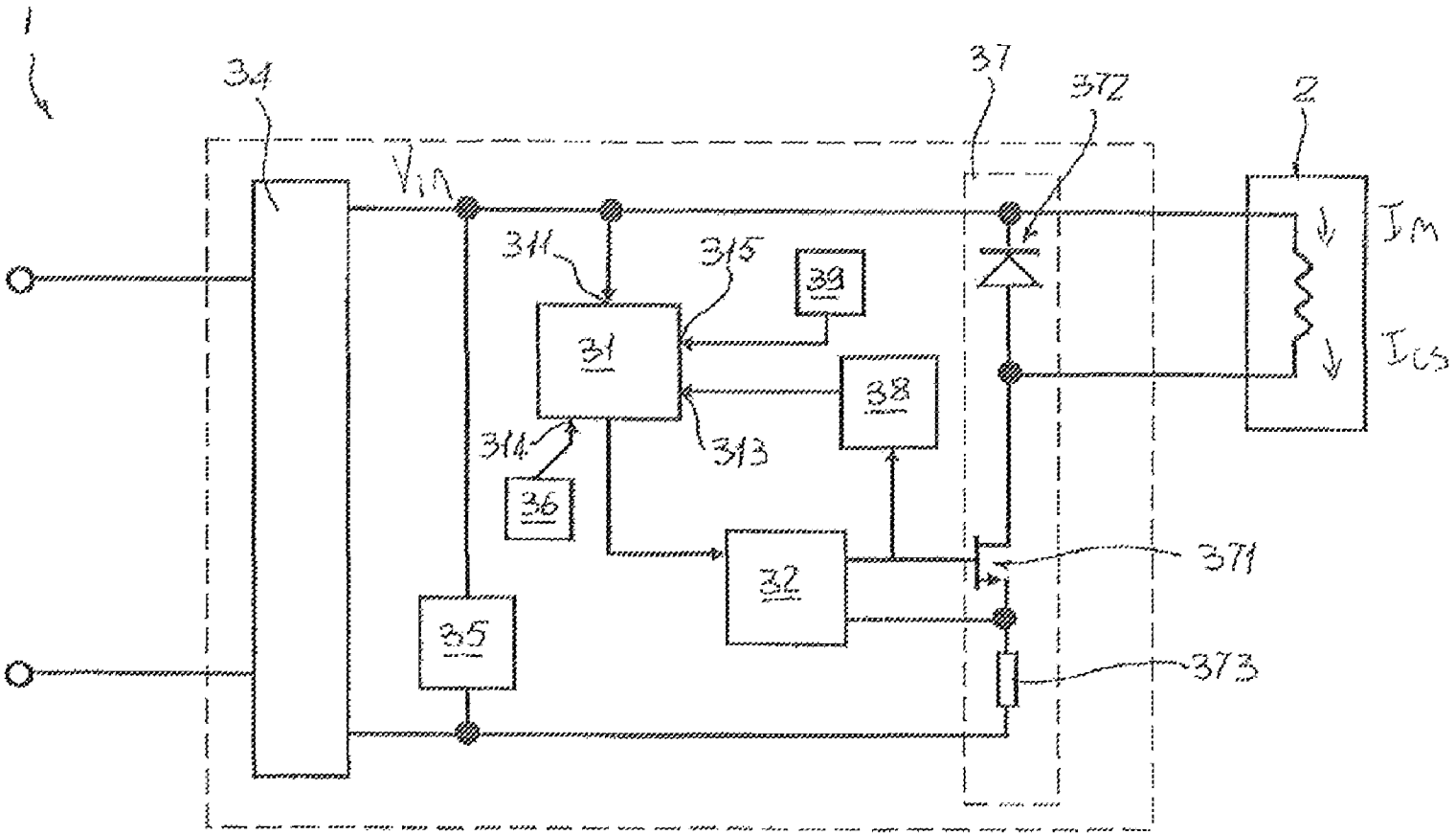
FIG. 2 is a schematic view of a first preferred embodiment of a single coil actuator according to the invention.

As shown in FIG. 2, a jumper 39 can be conveniently provided in order to allow resetting of the configurable parameters through a digital input 315.

As shown in the attached figures, in a preferred embodiment of the single coil actuator 1 according to the invention, the first control unit 31 is conveniently operatively connected to said second control 32 unit through a first analogue output 312 for setting the current Iset flowing in said single coil electromagnet 2. Then, a second analogue input 313 of said first control unit 31 is operatively connected to an output 321 of said second control unit 32 for measuring the output duty cycle of said PWM controller.

In practice, the PWM controller duty cycle allows detecting a change in the impedance of the electromagnetic coil 2. The duty cycle depends on the input voltage, the coil current settings and the coil impedance. Being that all other parameters are known, the coil impedance can therefore be calculated as a function of the measured duty cycle. This is extremely important as it allows to perform coil continuity check, as better explained further on.

Preferably, a low pass filter 38 is used to convert the output duty cycle of said PWM controller into a voltage measurable by said first control unit 31.

As shown in FIG. 2, in the single coil actuator 1 according to the present invention, the power circuit 37 preferably comprises a MOSFET 371 to drive said single coil electromagnet 2, a freewheeling diode 372 and a sense resistor 373 for measuring the current Im circulating in said single coil electromagnet 2.

In practice, the PWM controller 32 drives the MOSFET device 371 and regulates the current flowing in the coil according to the value of current setting Iset received from the first control unit 31 through the first analogue output 312 thereof.

Thus, the second control unit 32 conveniently comprises a MOSFET driver to control the MOSFET gate; it also comprises a comparator to compare the measured value Im of the current circulating in said single coil electromagnet 2 with the value of current Iset which is set by said first control unit 31.

It is worth noting that since the current circulating in the coil and power circuit is limited by the PWM controller 32 to the Iset value, the risk of having over currents circulating in the system is consequently avoided. Furthermore the current circulating in the coil does not depend on the input voltage and ambient temperature.

According to a preferred embodiment of the single coil actuator 1 according to the invention, said first control unit 31 comprises a third analogue input 314 for detecting the temperature, through a temperature detector 36. As an example, the analogue input 314 can be connected to an NTC resistor that measures the temperature of the electronic board. Temperature protection could also be integrated into the power supply 35 and, in case of excess temperature, powering of blocks 31 and 32 is stopped.

Figure 3:
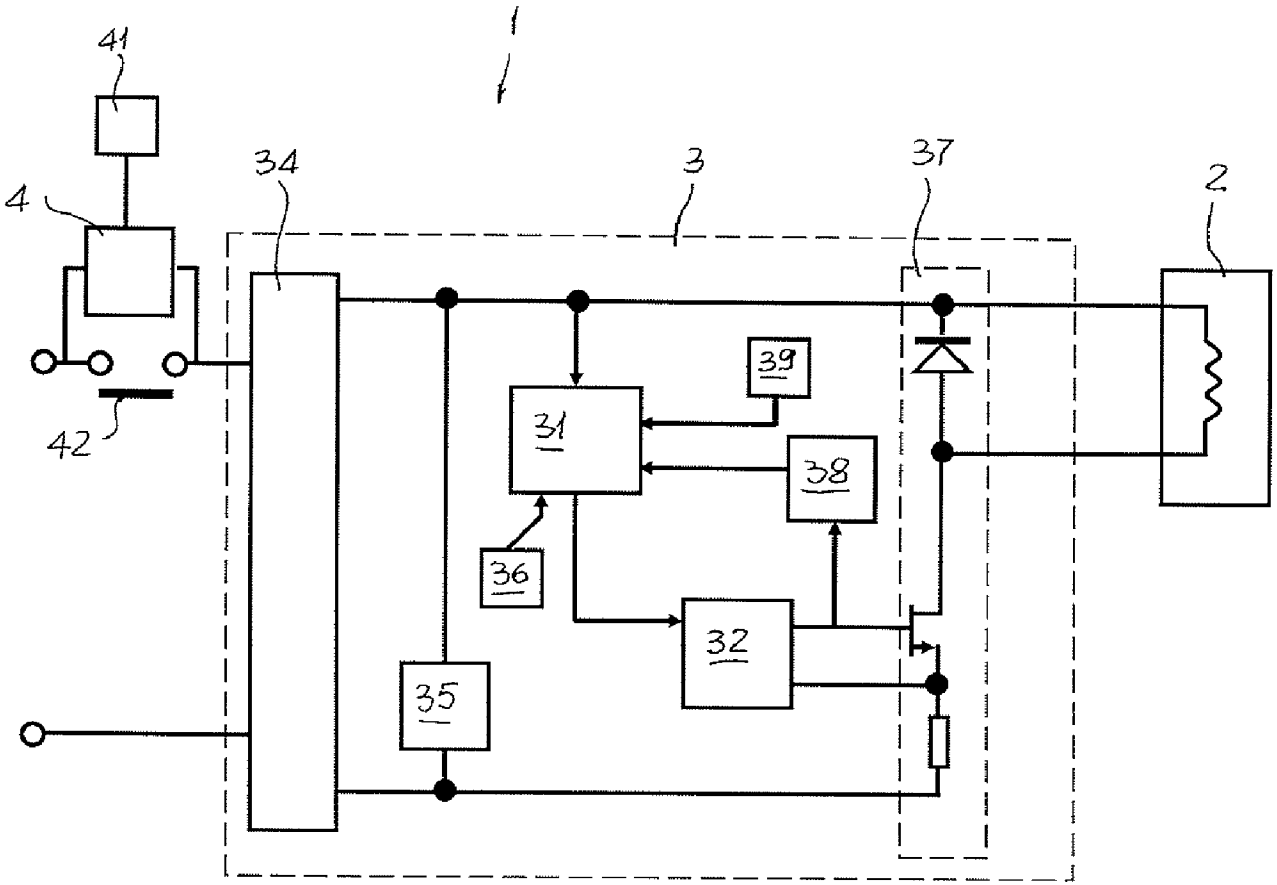
FIG. 3 is a schematic view of a second preferred embodiment of a single coil actuator according to the invention.

A particular embodiment of the single coil actuator 1 according to the invention, shown in FIG. 3, foresees that said power and control unit 3 is operatively connected to a trip circuit supervisor 4 that allows detecting failure in the coil winding or electronic board.

From an operative standpoint, the functioning of the single coil actuator 1 of the invention can be the following.

A predetermined minimum value Vmin is required by the power supply block 35 in order to power up the microcontroller 31 and the PWM controller 32. For instance the minimum voltage required can be determined on the basis of the MOSFET 37 characteristics and the voltage drop due to the AC to DC conversion at block 34. Thus, if the input voltage Vin is below the minimum value Vmin the system does not work.

The first control unit 31 continuously checks the input voltage Vin through the first analogue input 311 and, depending on the voltage value, detects a launch event or release event. The launch event is detected when the input voltage Vin is increased and is greater than a predetermined launch threshold value Vth_rise, while the release event is detected when the input voltage Vin is decreased and is lower than a predetermined release threshold value Vth_fall.

In other words, the coil activation sequence foresees that a voltage rise above a predetermined level Vth_rise determines the launch and hold operation of the electromagnet, while a voltage fall below a predetermined level Vth_fall determines the release operation of the electromagnet, the launch threshold value Vth_rise being always higher than the release threshold value Vth_fall.

In practice, when the first control unit 31 detects an increase of the input voltage Vin above the threshold value Vth_rise, the value of the current circulating in the single coil electromagnet 2 is set and maintained at a predetermined launch level Il for a predetermined launch time Tl. After expiration of said predetermined launch time Tl, the current is reduced to and maintained at a predetermined hold level Ih until when a decrease of said input voltage Vin below the release threshold value Vth_fall is detected and the coil is consequently released.

Preferably, the coil activation sequence includes predetermined delay times for the launch and release operation. In this case, when the launch event is detected, the coil launch is delayed by a predetermined launch delay time Tld. The current is then set and maintained at the predetermined launch level Il for the predetermined launch time Tl. When the time Tl is elapsed the current is reduced to and maintained at the predetermined hold level Ih and, when a release event is detected, the hold current Ih is still maintained for a predetermined release delay time Trd. Finally, after the time Trd is elapsed, the coil is immediately released.

In the particular case that a release event is detected during the launch delay time Tld, the coil activation sequence is interrupted and the subsequent phases aborted.

One of the particularly preferred features of the single coil actuators of the present invention is its capability to perform a check of the integrity of the coil and electronic board (coil supervision and feedback routine). To this end, a coil supervision current Ics is allowed to circulate through the single coil electromagnet 2. In particular, the continuity check can be activated when the first control unit 31 detects an input voltage value Vin which is between said predetermined minimum value Vmin and said release threshold value Vth_fall; in such a case, a coil supervision current Ics, which is lower than said launch current Il, is allowed to circulate in said single coil electromagnet.

Control of the continuity and coil supervision can be done by checking the output duty cycle of the PWM controller 32. As already said before, the duty cycle depends on the input voltage, the coil current settings and the coil impedance. Thus, being that the input voltage value Vin is known and the current value is set at Ics, any change in the operability of the single coil electromagnet 2 can be detected by checking the output duty cycle of the PWM controller. To this purpose a predetermined acceptance range for the PWM output duty cycle is defined. If the value of said PWM output duty cycle is outside of said predetermined range, the coil supervision current Ics is interrupted and all activities of the single coil actuator are stopped.

Thus, the operation cycle of the single coil actuator of the present invention can be summarized as follows. At power up, and if the input voltage Vin is greater than the minimum voltage Vmin, the system executes the coil supervision and feedback routine described above, until a launch event is detected. When the launch event is detected, the system executes the coil activation sequence described above. Finally, when the release event is detected, the system completes the coil activation sequence and immediately after it executes the coil supervision and feedback routine.

Preferably, as illustrated in FIG. 3, said power and control unit 3 is operatively connected to a trip circuit supervisor 4 that allows detecting failure in the coil winding or electronic board. The trip circuit supervisor 4 can be a supervision relay of common type that drives a small current in the circuit to detect its continuity and generate an alarm 41 in the event the current cannot circulate.

As shown in FIG. 3, the trip circuit supervisor 4 works when the contact 42 is open, i.e. when the single coil electromagnet 2 is not energized. The supervision current Ics circulating in the single coil electromagnet 2 during the coil supervision and feedback routine is correlated to the current Itc circulating in the trip circuit supervisor 4.

In particular the current Itc circulating in the trip circuit supervisor 4 can be calculated with the formula:

$$Itc=Ics\times PWM_DC+Iq,$$

where PWM_DC is the output duty cycle of the PWM controller and Iq is the quiescent current (i.e. the current needed by the electronic circuit of the single coil actuator to stay active). Thus, in the event the supervision current Ics is stopped due to a failure in the winding of the single coil electromagnet 2, the current Itc circulating in the trip circuit supervisor 4 is equal to the quiescent current Iq. It is therefore possible to set minimum current values that the trip circuit supervisor 4 detects as a pass condition and in the event the current Ics is interrupted (due to a failure in the connection continuity or in the electromagnet winding) an alarm signal 41 is generated.

A further feature of the single coil actuator of the present invention is its capability of performing a protection against over-temperatures. To this purpose the software continuously checks the temperature of the system through the third analogue input 314 of the microcontroller 31.

Conveniently, when a dangerous temperature is reached, i.e. when the temperature detected is above a predetermined value, the second control unit 32 is disabled. In this way power dissipation (and consequently the self heating) is reduced without interrupting the power supply and the electronic components remain powered. Self destruction of the single coil actuator 1, and in particular of the electronic board, due to over temperatures can therefore be avoided.

It is clear from the above that the single coil actuator for low and medium voltage applications of the invention have a number of advantages with respect to similar units of known type having the same functionality.

In particular, from a construction standpoint it is much simpler than conventional actuators, as only a single coil is required to perform the launch, hold and release operation. Then, the power and control unit 3 drives the single coil electromagnet 2 in a simple and effective manner: the value of current that is allowed to circulate in the single-coil electromagnet 2 is set by the first control unit 31 (microcontroller) as a function of the magnetomotive force needed for the operation to be performed (launch or hold) and of the characteristics of the winding (e.g. copper sections, number of turns); the actual control of the current is then performed by the second control unit 32 (PWM controller) that regulates the current circulating in the single-coil electromagnet. In this way it is possible to reduce the number of electromagnet variants, thereby significantly reducing the manufacturing and handling costs.

The current control performed by the second control unit 32 also allows to avoid, or at least reduce at a minimum, the risk of failures due to overcurrents circulating in the system.

A further important advantage of the single coil actuator for low and medium voltage applications according to the invention is the possibility of checking the continuity and the proper functioning of single coil electromagnet 2 as well as of the electrical connection by carrying out the coil supervision and feedback routines described above. This is extremely important as it increases the reliability of the single coil actuator itself as well as of the medium voltage apparatus in which it is installed.

Also, the thermal control and thermal shut-down routine avoid, or at least minimize, the risks of failures and destruction due to over-temperatures.

The single coil actuator for low and medium voltage applications thus conceived may undergo numerous modifications, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A single coil actuator for low and medium voltage applications comprising:

a single coil electromagnet and a power and control unit operatively connected to said single coil electromagnet, said power and control unit comprising:

a first control unit and a second control unit;

a power input operatively connected to an input filter and rectifier;

a power supply operatively connected to said input filter and rectifier and to said first and second control unit;

a power circuit operatively connected to said single coil electromagnet;

said first control unit being a microcontroller including analogue and digital inputs and outputs, said second control unit being a PWM controller which controls the current flowing in the single coil electromagnet through said power circuit, wherein said first control unit is operatively connected to said second control unit through a first output for setting the current flowing in said single coil electromagnet, wherein a second input of said first control unit is operatively connected to an output of said second control unit for measuring the output duty cycle of said PWM controller, wherein said first control unit is capable of calculating a change in the impedance in said single coil electromagnet on the basis of the measure of the output duty cycle of said PWM controller.

2. The single coil actuator according to claim 1, characterized in that said first control unit is operatively connected to said power supply through a first input for measuring the input voltage (Vin) and detect launch and release threshold values of said input voltage (Vin).

3. The single coil actuator according to claim 1, characterized in that a 10 W pass filter is used to convert said output duty cycle of said PWM controller into a voltage measurable by said first control unit.

4. The single coil actuator according to claim 1, characterized in that said power circuit comprises a MOSFET to drive said single coil electromagnet, a freewheeling diode and a sense resistor for measuring the current (Im) circulating in said single coil electromagnet.

5. The single coil actuator according to claim 4, characterized in that said MOSFET is driven by said second control unit.

6. The single coil actuator according to claim 5, characterized in that said second control unit comprises a comparator to compare said measured value (Im) of the current circulating in said single coil electromagnet with the value of current (Iset) set by said first control unit.

7. The single coil actuator according to claim 1, characterized in that said first control unit comprises a third input for measuring the temperature of said single coil electromagnet.

8. The single coil actuator according to claim 1, characterized in that said power and control unit is operatively connected to a trip circuit supervisor.

9. The single Coil actuator according to claim 2, characterized in that when said first control unit detects an increase above a launch threshold value (Vth_rise) of said input voltage (Vin), the value of the current, circulating in the single coil electromagnet is set at a predetermined launch level (Il) for a predetermined launch time (Tl), and is then reduced to and maintained at a predetermined hold level (Ih) until when a decrease below a release threshold value (Vth_fall) of said input voltage (Vin) is detected, said release threshold value (Vth_fall) being lower than said launch threshold value (Vth_rise).

10. The single coil actuator according to claim 9, characterized in that when said first control unit detects an input voltage value (Vin) which is between said release threshold value (Vth_fall) and a predetermined minimum value (Vmin), a coil supervision current (Ics) lower than said launch current (Il) is allowed to circulate in said single coil electromagnet.

11. The single coil actuator according to claim 1, characterized in that when the value of the output duty cycle of said PWM controller is outside of a predetermined range, said coil supervision current (Ics) is interrupted.

12. The single coil actuator according to claim 8, characterized in that said trip circuit supervisor is activated when said coil supervision current (Ics) is allowed to circulate in said single coil electromagnet and it generates an alarm signal when said coil supervision current (Ics) is interrupted.

13. The single coil actuator according to claim 7, characterized in that when the temperature of said single coil electromagnet is above a predetermined value, said second control unit is disabled.

14. The single coil actuator according to claim 2, characterized in that said first control unit is operatively connected to said second control unit through a first output for setting the current (Iset) flowing in said single coil electromagnet.

15. The single coil actuator according to-claim 2, characterized in that said power circuit comprises a MOSFET to drive said single coil electromagnet, a freewheeling diode and a sense resistor for measuring the current (Im) circulating in said single coil electromagnet.

16. The single coil actuator according to claim 1, characterized in that said power circuit comprises a MOSFET to drive said single coil electromagnet, a freewheeling diode and a sense resistor for measuring the current (Irn) circulating in said single coil electromagnet.

17. The single coil actuator according to claim 1, characterized in that said power circuit comprises a MOSFET to drive said single coil electromagnet, a freewheeling diode and a sense resistor for measuring the current (Im) circulating in said single coli electromagnet.

18. The single coil actuator, according to claim 3, characterized in that said power circuit comprises a MOSFET to drive said single coil electromagnet, a freewheeling diode and a sense resistor for measuring the current (Im) circulating in said single coil electromagnet.

* * * * *